US007261613B1

(12) United States Patent
Hull

(10) Patent No.: US 7,261,613 B1
(45) Date of Patent: Aug. 28, 2007

(54) RECIPROCATING PLAYTHING AND METHOD FOR PLAYING

(76) Inventor: Everett Hull, 72 Elizabeth St., Basking Ridge, NJ (US) 07920

( * ) Notice: Subject to any disclaimer, the term of this patent is extended or adjusted under 35 U.S.C. 154(b) by 0 days.

(21) Appl. No.: 11/010,103

(22) Filed: Dec. 10, 2004

(51) Int. Cl.
*A63H 18/02* (2006.01)
*A63H 18/00* (2006.01)

(52) U.S. Cl. ..... 446/444; 446/478; 472/89

(58) Field of Classification Search ..... 472/59, 472/6, 16, 137, 88, 89, 91; 446/429, 430, 446/432, 444
See application file for complete search history.

(56) References Cited

U.S. PATENT DOCUMENTS 4,076,245 A * 2/1978 Monroe ..... 463/69
4,571,204 A * 2/1986 Wang ..... 446/138
5,174,569 A * 12/1992 Ngai ..... 463/63
5,232,423 A * 8/1993 Hajduczek ..... 482/68
5,749,615 A * 5/1998 Itson ..... 296/26.03
6,071,167 A * 6/2000 Yang ..... 446/236
6,350,174 B1 * 2/2002 Halford et al. ..... 446/444
6,676,480 B2 * 1/2004 Sheltman ..... 446/429

* cited by examiner

*Primary Examiner*—Kien Nguyen
(74) *Attorney, Agent, or Firm*—Thomas L. Adams

(57) ABSTRACT

A plaything for executing a reciprocating activity has a curved platform reciprocatably mounted on a base. The platform has a traveling surface with a longitudinally spaced, opposing pair of end ramps. A coaster can travel back and forth freely on the platform. The end ramps are inclined to cause reversion of the coaster.

18 Claims, 5 Drawing Sheets

RECIPROCATING PLAYTHING AND METHOD FOR PLAYING

BACKGROUND OF THE INVENTION

1. Field of the Invention

The present invention relates to playthings for executing a reciprocating activity, and in particular, to playthings with a traveling coaster.

2. Description of Related Art

Skateboarders accomplish remarkable athletic feats by traversing the opposing banks or ramps of a half pipe, using the banks to reverse their direction of traversal. Using a similar structure snowboarders and BMX bikers perform comparable athletic feats by riding from one bank to an opposite bank, again reversing direction at the peak of travel.

In U.S. Pat. No. 6,350,174 a miniature roll-up half-pipe is used with a miniature fingerboard 60. The user places a finger on the upper surface of the fingerboard 60 and rolls it back and forth along flexible sheet 35, manipulating it to perform typical skateboard stunts.

In U.S. Design Pat. 487,486 a toy road racing skateboard has a miniature rider mounted on top.

In U.S. Pat. No. 6,540,577 a fingerboard contains magnetic material, and can be manipulated to perform typical skateboard tricks using a finger ring 30 or fully poseable action figure 50.

In U.S. Pat. No. 6,742,780 a skateboard maze has a board with grooves on its topside forming the maze. The grooves are deep enough to hold a ball. The user stands on top of the board and rocks it back and forth, causing the ball to move through the maze.

In U.S. Pat. No. 2,433,995 an electromagnet 6 is controlled by switches 13 and 14. The user opens and closes the circuit to cause a metal ball to roll towards target 9 mounted in a spherical bowl.

In U.S. Pat. No. 4,055,341 a maze is provided in platforms 22 and 24. The user stands on a textured traction surface 46 and rocks the platforms to move a ball toward a goal at the end of the maze.

In U.S. Pat. No. 4,681,320 a top spins on a hinged game board. The user can move the game board to steer the top on spiral path 18 from a start to a finish point.

In U.S. Pat. No. 4,394,961 jumping-off ramp 1 and jumping-on ramp 2 are arranged opposite one another on two track sections. A toy vehicle 4 leaves ramp 1 at an angle that can be adjusted using handle 1c.

In U.S. Pat. No. 6,726,523 a remote controlled toy skateboard device includes a toy figure mounted on a skateboard. The speed and direction of travel for the device is controlled by a portable remote control unit.

In U.S. Pat. No. 6,776,685 a collapsible toy vehicle ramp has a flexible panel, used as a jumping surface. The ramp is designed to collapse under weight exceeding the normal weight for a toy vehicle.

In U.S. Pat. No. 6,623,367 a fingerboard ramp includes at the intersection of sections 36 and 38 an edge coping 44 made of metal tubing. See also U.S. Pat. Nos. 4,251,949; and 5,409,223.

Accordingly, there is in need for a plaything that allows a player to execute a reciprocating activity, especially an activity where a coaster travels up an inclined ramp before reversing direction and traveling towards an opposite ramp.

SUMMARY OF THE INVENTION

In accordance with the illustrative embodiments demonstrating features and advantages of the present invention, there is provided a plaything for executing a reciprocating activity. The plaything has a curved platform reciprocatably mounted on a base. The platform has a traveling surface with a longitudinally spaced, opposing pair of end ramps. A coaster can travel back and forth freely on the traveling surface. The end ramps are inclined to cause reversion of the coaster.

In accordance with another aspect of the invention a method is provided for playing with a coaster on a curved platform having a traveling surface with a longitudinally spaced, opposing pair of end ramps. The method includes the step of placing the coaster on the traveling surface. Another step is reciprocating the platform longitudinally to cause the coaster to travel back and forth freely on the platform between the end ramps. The reciprocation is timed to cause periodic reversion of the coaster after arrival at each of the end ramps.

In accordance with still another aspect of the invention a plaything is provided for executing a reciprocating activity. The plaything includes a curved platform having a traveling surface with a longitudinally spaced, opposing pair of end ramps. Also included is a coaster for traveling back and forth freely on the traveling surface. The end ramps are inclined to cause reversion of the coaster. The platform is manually reciprocatable to cause the coaster to travel back and forth between the ramps.

By employing structure and methods of the foregoing type, an improved plaything and play activity is achieved. In one embodiment, a coaster in the form of a wheeled carriage travels back and forth on a movable platform between opposing inclined ramps. In this embodiment, the platform is reciprocated by a player to cause the coaster to travel between the inclined ramps, reversing direction at the peak of its travel on the ramps. The coaster can be designed to look like a miniature skateboarder, biker, snowboarder, automobile, skier, etc.

The player can reciprocate the platform longitudinally (i.e., moving the ramps anteriorly and posteriorly) to propel the coaster between the ramps. The player can also twist the platform or move it transversely to steer the coaster. In this fashion a skillful player can turn the coaster on the ramps so it keeps traveling nose first.

In one embodiment the platform rolls on ball bearings on the top of a base. The base may have manual controls in the form of a pair of joysticks rotatably mounted by ball and socket joints at a control panel on the base. The joysticks each have an internal proximal shaft that links to a plate that is attached to the bottom of the platform. Thus by operating the joysticks the player can translate the platform in two dimensions (i.e., longitudinally and transversely). Also, by moving the joysticks differentially, the player can rotate the platform about a vertical axis.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
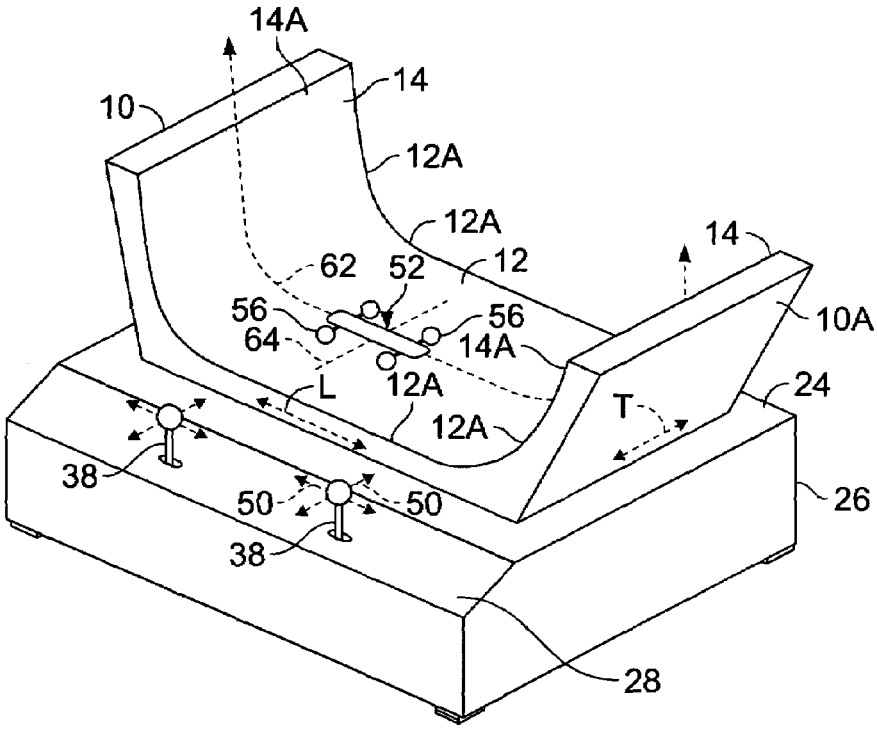
FIG. 1 is a perspective view of a plaything in accordance with principles of present invention.

Referring to FIGS. 1-6, the illustrated plaything has a platform 10 with a traveling surface 12 that extends longitudinally into an opposing pair of end ramps 14. The upper portions 14A of ramps 14 are almost vertical and in some embodiments may actually curl into an overhang. The platform 12 is gutter-like and is intended to simulate in miniature the half pipe that might be used by a skateboarder, BMX biker, snowboarder etc. The outside faces 10A of platform 10 are inclined and diverge outwardly. In one embodiment platform 10 has an overall length of 20 inches (51 cm), a transverse width of 14 inches (36 cm) and an overall height of five inches (13 cm) although these dimensions can be different in other embodiments. Platform 10 may be injection molded plastic, but in some embodiments may be a sheet metal stamping, ceramic molding, metal casting, wood carving, etc.

In this embodiment traveling surface 12 is shown curved along a central, ramp-to-ramp travel path 62, but not curved in a transverse direction; for example, not curved in the transverse direction of transverse centerline 64. In other embodiments most of the traveling surface 12 can be bowl-shaped, that is, concave in both a transverse direction T and a ramp-to-ramp direction 62. Such a bowl shape tends to bring coaster 52 toward the central travel path 62, thereby preventing the coaster from falling off traveling surface 12. Instead of using a bowl shape, some embodiments may keep coaster 52 in play by installing a fence (not shown) along the edges 12A of surface 12.

Figure 2:
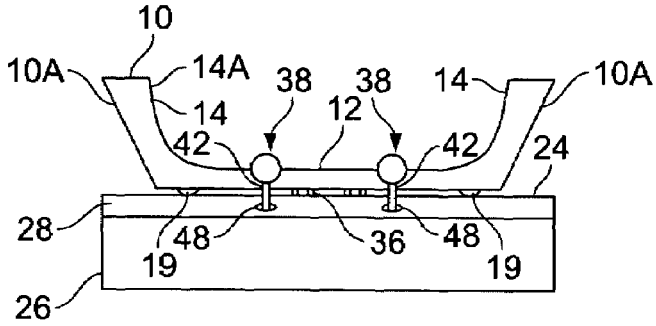
FIG. 2 is a front elevational view of the plaything of FIG. 1.
Figure 3:
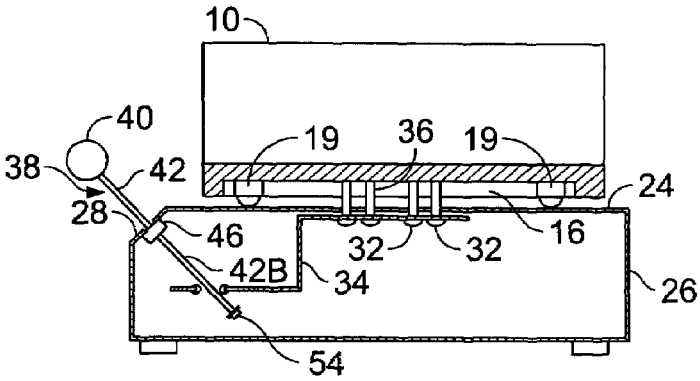
FIG. 3 is a side elevational view, in cross-section, of the plaything of FIG. 1.
Figure 4:
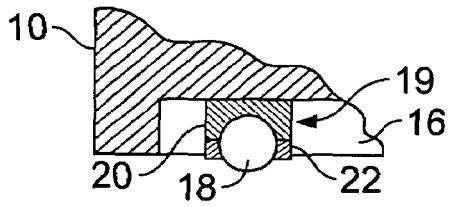
FIG. 4 is a detailed, sectional view of one of the rollers of the platform of FIGS. 1-3.

The underside of platform 10 has a rectangular recess 16 that is lined with metal sheet 27, which may be glued in place. Attached in the corners of recess 16 are four subjacent rollers 19, shown in FIG. 4 as ball bearing 18 mounted in socket 20 and captured by annular cap 22, which may be attached by screws, threads, or the like. FIGS. 2 and 3 show rollers 19 rolling on topside 24 of a base 26. Base 26 is a substantially rectangular casing with its upper front corner beveled to form a control panel 28. In one embodiment the overall dimensions of base 26 are 24"×18"×5" (61 cm×46 cm×13 cm) although these dimensions can be different in other embodiments. Base 26 may be made of plastic, metal, ceramic, etc. In some embodiments base 26 may have a pair of carrying handles for transporting the plaything.

Figure 5:
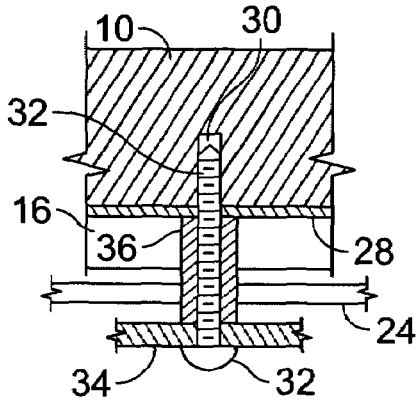
FIG. 5 is a detailed view, partly in section, of the joint between the platform and the plate of FIG. 3.
Figure 6:
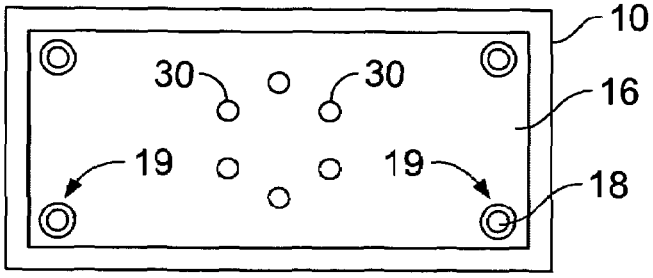
FIG. 6 is a bottom view of the platform of FIG. 1.

Bores 30 on the underside of platform 10 align with matching holes in metal sheet 27 and are designed to each receive self tapping screw 32 (FIG. 5). Screw 32 is inserted through a hole in plate 34 and the bushing 36 before being threaded into bore 30. Accordingly, plate 34 is attached to the underside of platform 10 and stands off by the distance determined by bushing 36.

Figure 7:
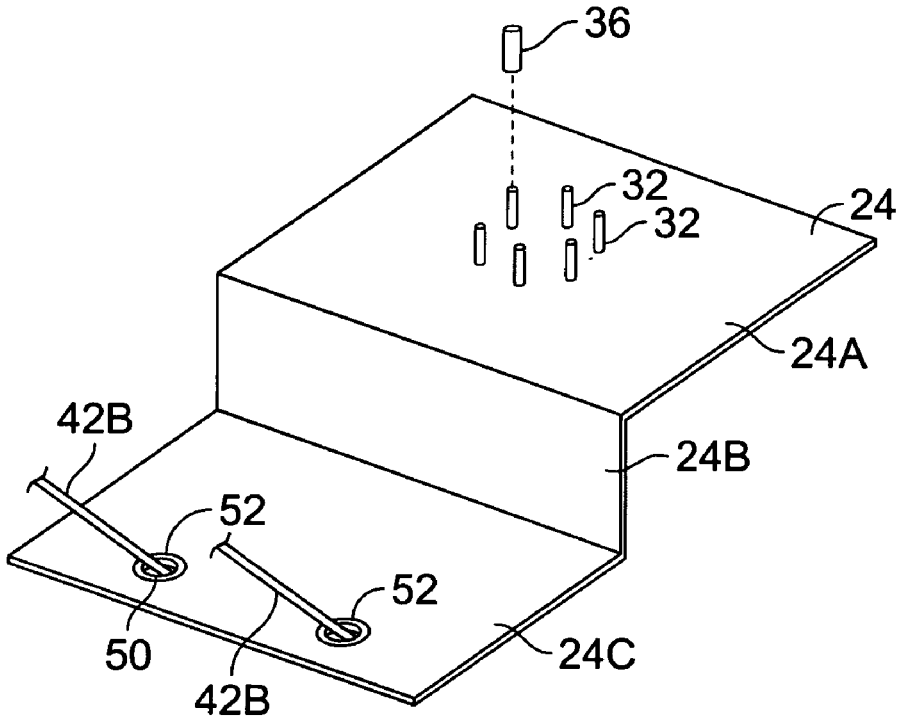
FIG. 7 is a perspective view of the plate of FIG. 3.
Figure 8:
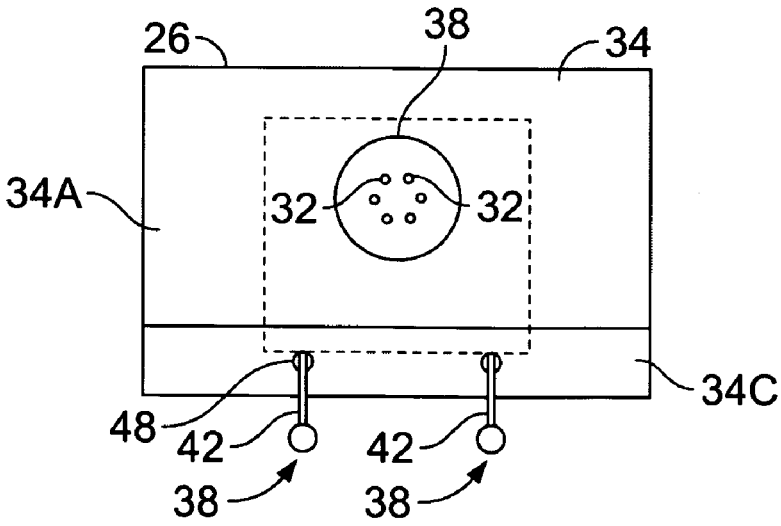
FIG. 8 is a top view of the base of FIG. 1 with the platform removed.

Referring to FIGS. 7 and 8, screws 32 in plate 34 project through a central hole 38 in the topside 24 of base 26. Plate 34 is shown as a stepped structure with an upper plateau 34A, a riser 34B, and a lower plateau 34C.

Figure 9:
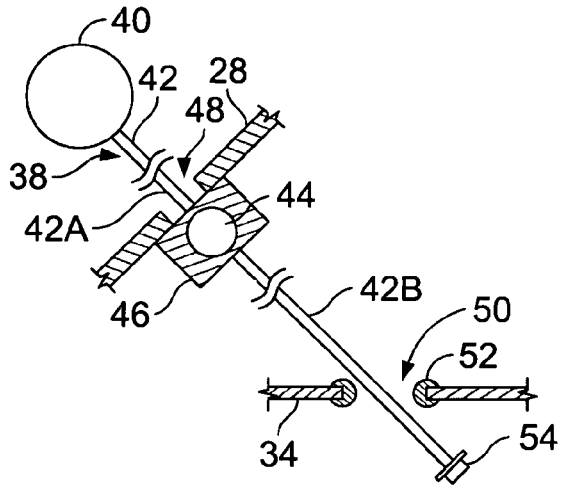
FIG. 9 is a detailed view, partly in section, of one of the manual controls on the base of FIG. 1.

Referring again to FIGS. 1-6 and also to FIG. 9, plate 34 is shown inside base 26, attached to the underside of platform 10 and reaching forwardly to a position below the control panel 28. A pair of manual controls 38 are shown projecting through control panel 28. In this embodiment controls 38 are a pair of joysticks with a spherical handle 40 molded on the upper end of a metal rod 42. A plastic ball 44 is molded around rod 42 to divide the rod into an external distal shaft 42A and a proximal internal shaft 42B. Ball 44 is rotatably mounted in a socket 46 that is attached to the underside of control panel 28 in alignment with hole 48. Accordingly, joysticks 38 can tilt in the two directions 50 (FIG. 1), giving the axes of each of the joysticks 38 two rotational degrees of freedom.

Proximal shaft 42B can likewise move with two degrees of freedom. Proximal shaft 42B is shown coupled to plate 34 by insertion through its hole 50, which is rimmed with a plastic grommet 52. Secured to the end of proximal shaft 42B is a hat-shaped cap 54 locked in place by internal barbs (not shown) and designed to prevent shaft 42B from disengaging plate 34.

Figure 10:
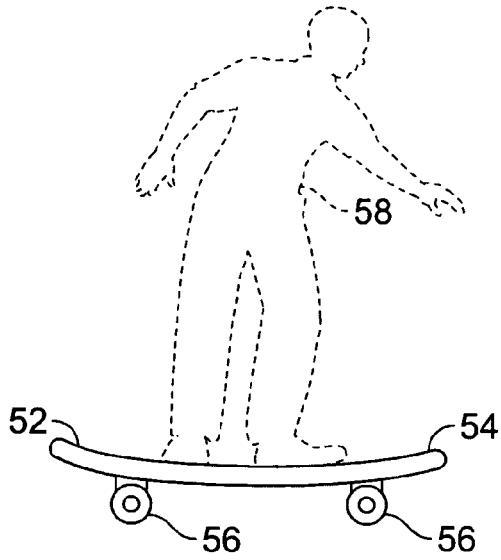
FIG. 10 is an elevational view of the coaster of FIG. 1.
Figure 11:
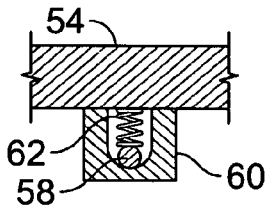
FIG. 11 is a detailed view of one of the journals of the coaster of FIG. 10.

Referring to FIGS. 1, 10 and 11, a coaster 52 is shown as a carriage 54 with a plurality of wheels 56 made of an elastomer such as neoprene. Wheels 56 are mounted in pairs on the ends of two separate axles 58. Each axles 58 is mounted in a pair of journals, one such journal 60 being shown in FIG. 11. Specifically, shaft 58 is downwardly biased by compression spring 62 to give the shafts and wheels 56 some ability to absorb jolts.

In this embodiment, carriage 54 is shaped like a miniature skateboard. In some embodiments an optional miniature skateboarder 58 can be mounted atop board 54. Skateboarder 58 may be a molded plastic figure or simply a cardboard cutout fitted into a slot atop board 54. The coaster 52 is designed with a low center of gravity and a weight of about 3-5 ounces (86-143 grams). This weight can be accomplished by casting board 54 in metal or by fitting a plastic board with metal weights.

In other embodiments board 54 may be shaped like a snowboard and can be fitted with a miniature snowboarder. In still other embodiments the coaster may be made in the shape of a BMX bicycle with a rider. This bicycle can ride on its two wheels and be stabilized by wheels on outriggers similar to training wheels used on children's bicycles. Alternatively, the coaster can be in the form of a miniature automobile, a skier, etc. In the simplest embodiments, the coaster may be a ball or marble.

Figure 12:
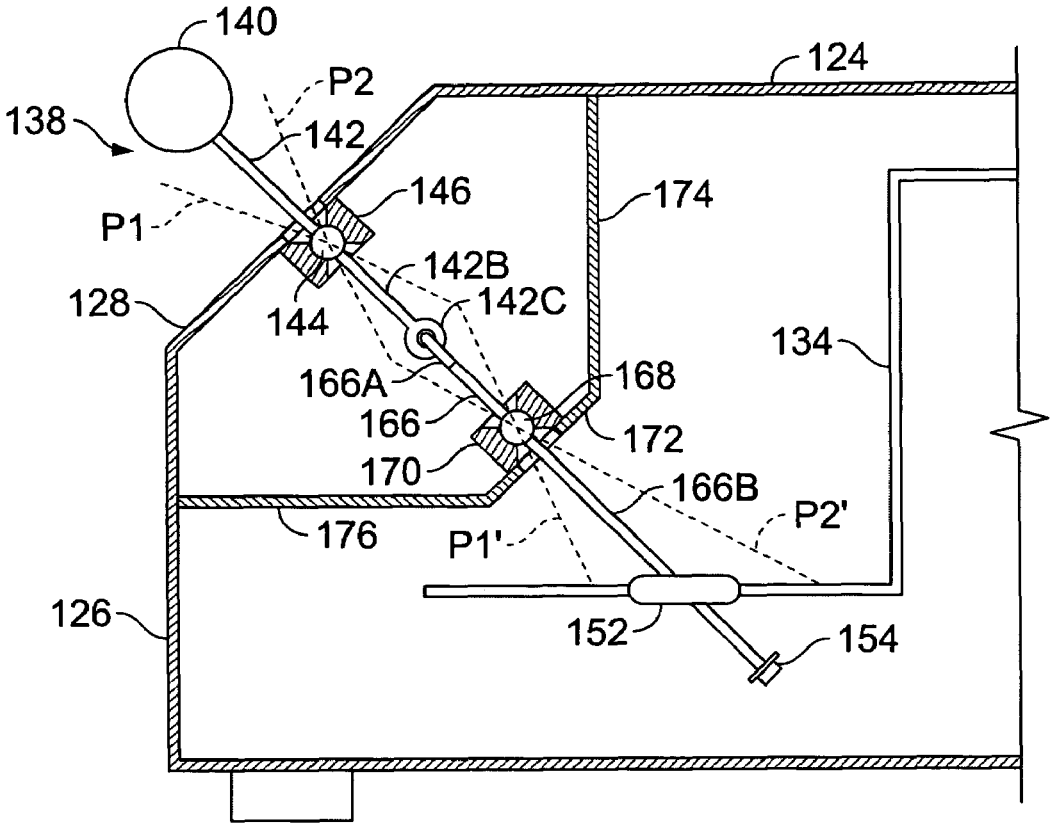
FIG. 12 is a sectional, side elevational view of a portion of a plaything that is an alternate that described above.
Figure 13:
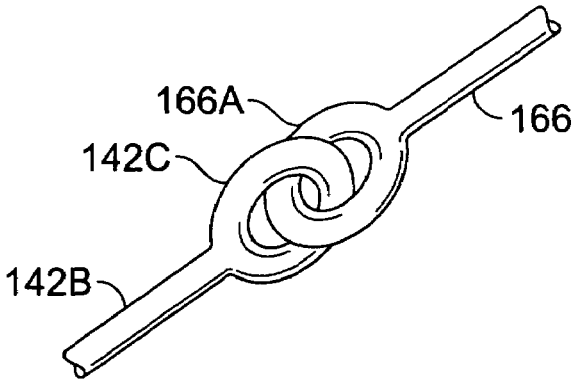
FIG. 13 is a detailed perspective view of the knuckle joint shown in FIG. 12.

Referring to the alternate embodiment of FIGS. 12 and 13, components corresponding to those previously illustrated bear the same reference numeral but increased by 100. In particular, base 126 is a hollow case with a horizontal topside 124 and a slanted control panel 128.

In this embodiment controls 138 are again a pair of joysticks, each with a spherical handle 140 molded on the upper end of a metal rod 142. A plastic ball 144 is molded around rod 142 and is rotatably mounted in a socket 146 that is attached to the underside of control panel 128. A proximal portion 142B of rod 142 is connected through a knuckle joint to the distal end of rod 166. This knuckle joint is accomplished by terminating rod 142B in an eye 142C that is linked through an eye 166A in the distal end of rod 166.

Plastic ball 168 is molded around rod 166 and is rotatably mounted in a socket 170 that is attached atop a slanted panel 172. Panel 172 is supported by a vertical wall 174 and horizontal wall 176, which are each attached to the interior of base 126. The proximal portion 166B of rod 166 passes through a hole, in panel 172 and a grommet 152 mounted in a hole in plate 134. Plate 134 is bolted to previously mentioned platform 10.

The foregoing linkage alters the response of plate 134 to movement of joystick 138. If joystick 138 is pushed away from the user from position P1 to position P2, eye 166B swings down so that proximal portion 166B of rod 166 swings up from position P1' to position P2'. Consequently, moving joystick 138 away from the user will also cause plate 134 and the platform 10 (FIG. 1) to move away from the user. Also, pulling joystick 138 toward the user will move plate 134 and the platform toward the user as well. Similarly, swinging joystick 138 to the right (left) will cause plate 134 and the attached platform to shift to the right (left). It will be noted that eyes 142C and 166A forming the knuckle joint are loosely linked to accommodate the tendency of the eyes to separate when swung to an extreme position.

To facilitate an understanding of the principles associated with the foregoing apparatus, the operation of the embodiment of FIGS. 1-10 will be briefly described. Case 26 may be placed on a level surface and the player may grasp the two joysticks 38, one with each hand. Starting with the joysticks 38 in the neutral positions illustrated in FIGS. 1-3 the player may synchronously swing both joysticks 38 to the right (left). Consequently, proximal shafts 42B will both move to the left (right), thereby causing plate 34 to also move to the left (right). Since it is attached to platform 10 by screws 32, platform 10 will also move in the same direction as plate 34 (i.e., longitudinally) as the rollers 19 roll across topside 24. It will be appreciated that as the proximal shafts 42B swing they will also slide in and out of holes 50, with binding being avoided by friction-reducing grommets 52. It will be further noted that platform 10 and distal shafts 42A of the joysticks 38 move in opposite directions. Thus a rightward motion of the top of the joysticks 38 produces a leftward motion of the platform 10.

The player may instead synchronously grasp and swing both joysticks 38 up (down). Consequently, proximal shafts 42B will both move down (up), thereby causing plate 34 to move toward (away from) control panel 28. Since it is attached to plate 34 by screws 32, platform 10 will also move in the same direction as plate 34 (i.e., transversely) as the rollers 19 roll across topside 24. The motion of platform 10 will be reactive to motion of joysticks 38 in that upward (downward) motion of the tops of joysticks 38 brings platform 10 toward (away from) control panel 28.

The foregoing showed platform 10 being translated purely longitudinally (direction L), and then purely transversely (direction T). The player can also synchronously move the joysticks 38 obliquely, e.g., with components of upward and rightward motion. In circumstances where these components are equal, the center of platform 10 will move to the left and toward control panel 28 at 45° relative to the front of case 26. In this fashion the player can translate the center of platform 10 in any desired azimuthal direction.

In the foregoing cases joysticks 38 were always moved synchronously in the same direction so that platform 10 did not rotate. In some cases the player may keep one joystick 38 stationary and swing the other. In this case, the plate 34 will rotate about one of its holes 50. Consequently, the center of platform 10 will follow an arcuate path with two components of motion, that is, will follow a path with a with the changing balance of longitudinal component L and transverse component T. For example, if the left one of the joysticks 38 is stationary, lifting the other joystick 38 will cause platform 10 to rotate clockwise with the angular acceleration forces of this rotation greater at the right one of the ramps 14.

Note certain joystick motions are not possible such as swinging one of the joysticks 38 to the right while the other is swung to the left. In some instances, however, one of the joysticks 38 will be lifted up while the other one will be pulled down. In that case, starting from the illustrated neutral position, the center of platform 10 will translate along an arcuate path. Platform 10 will rotate as well, with the angular acceleration forces of this rotation being balanced between the right and left one of the ramps 14.

It is also possible to rotate platform 10 about some center of rotation without translating that center. For example, platform 10 can be rotated clockwise by moving the left one of the joysticks 38 up and to the left, while moving the right one down and to the left.

It will be appreciated that various combinations of joystick movements can cause complex motions of platform 10. In any event the two joysticks 38 can be moved synchronously in the same direction with two degrees of freedom. In this specification coordinates were described where one degree of freedom was defined as an up-and-down motion and the other degree was defined as a right-left motion, although other coordinate systems can be declared.

The foregoing dual joystick system can be considered as sharing a third degree of freedom associated with the rotation of platform 10. For example, the joysticks 38 can be manipulated to rotate platform 10 about its center before moving joysticks 38 in the same direction to accomplish two-dimensional translation of the platform. Therefore, the position of platform 10 can be defined by locating its center within a predetermined circular domain and by also defining its azimuthal orientation. It will be appreciated that opening 38 in the topside 24 of base 26 is dimensioned to accommodate the permissible placements of platform 10.

Play can be started by placing coaster 52 on one of the ramps 14 and allowing the coaster to travel down that ramp to the other. If nothing further is done coaster 52 will oscillate back and forth a few times before coming to rest in the center of traveling surface 12. Instead, however the player will move joysticks 38 right and left to harmonically reinforce the oscillation of coaster 52. Using joysticks 38 the player can move the platform to the right as the coaster 52 climbs the left one of the ramps 14 thereby adding kinetic and potential energy to the coaster 52. Eventually coaster 52 stops and reverses direction on the left one of the ramps 14 and travels towards the right one of the ramps 14. Now the player can move the platform to the left to add kinetic and potential energy to the coaster 52, before it stops and reverses direction to start another cycle.

In some cases the speed of coaster 52 is so high that it flies off the end of a ramp 14 to "catch air." The player can then retract that ramp so that coaster 52 will reliably reengage the ramp. In some embodiments the lip of the ramps 14 will be formed into an overhanging curl so that coaster 52 rides into that curl and flips.

Also, the player may move joysticks differentially to impart a twisting motion to platform 10. For example, as coaster 52 climbs one of the ramps 14 the player can move one of the joysticks 38 up while moving the other down to steer coaster 52 off the path 62. If done properly, coaster 52 will ride up ramp 14 nose first, turn and then travel down the ramp nose first. If the player wishes to create additional angular acceleration forces to accomplish this turn one of the joysticks 38 is kept stationary while the other is moved in an up-down direction. For example the left joystick can be kept stationary when the coaster 52 is traveling the right one of the ramps 14, allowing the right one of the joysticks 38 to impart more angular acceleration forces to that right ramp.

The embodiment of FIGS. 11 and 12 will be played in a similar manner, except that motion of the joystick will produce a response that is the opposite of that just described. Once the player has is accustomed to this type of movement, the play will proceed in a manner similar to that just described.

It is appreciated that various modifications may be implemented with respect to the above described, preferred embodiments. In some embodiments the joysticks can be replaced with wheels, levers, sliders, foot petals, cranks, etc. For example in some embodiments, especially those with coasters shaped as miniature automobiles, the joysticks can be replaced with a steering wheel and gear shift lever (or foot pedal). The shift lever (or foot pedal) can be linked to the platform by bicycle cables that control the longitudinal reciprocation of the platform, while the steering wheel can rotate the platform to accomplish steering of the miniature automobiles. In general, the linkage of the platform to the manual controls can be accomplished by pulleys, chains, levers, gear trains, slides etc. In some embodiments the manual controls can be electronic and can include potentiometers, switches, strain gauges, etc. For such embodiments, the actuators controlling movement of the platform can be solenoids, stepper motors, etc. In other embodiments the electrical controls can operate electromechanical valves that in turn operate hydraulic actuators that move the platform. Alternatively, the manual controls themselves can be hydraulic and can include pistons for applying pressure to a hydraulic fluid. Furthermore, automated embodiments may be employed where the platform automatically reciprocates right and left at a frequency and amplitude appropriate for sustaining back and forth motion of the coaster. In such embodiments, the player can be given controls that enable small perturbations of this oscillation in order to allow the player some influence over the speed and direction of the coaster. In simplified embodiments, the manual controls can be eliminated and the player can directly grasp the platform and manually reciprocate it on the base. In even simpler embodiments, the base can be eliminated and the player can manually move the platform with it suspended in the air or rolling or sliding on a table or other working surface. In some embodiments the traveling surface of the platform may have shallow ruts that tend to guide the coaster along predetermined paths. While the previously described platform moves without changing elevation, in other embodiments the manual controls can rock the platform about a transverse axis so that one ramp rises while the other descends. Alternatively, rocking can be accomplished by allowing one ramp to vertically reciprocate and then remain at a constant elevation followed by an interval where the other ramp vertically reciprocates. As still another alternative, the platform can be rocked by vertically reciprocating only one of the ramps while the other ramp remains at a constant elevation.

Obviously, many modifications and variations of the present invention are possible in light of the above teachings. It is therefore to be understood that within the scope of the appended claims, the invention may be practiced otherwise than as specifically described.

The invention claimed is:

1. A plaything for executing a reciprocating activity comprising:

a base:

a curved platform reciprocatably mounted on said base, said platform having a traveling surface with a longitudinally spaced, opposing pair of end ramps, said platform being mounted to reciprocate translationally with at least two degrees of freedom;

at least one manual control linked to said platform and manually operable to move said platform, said at least one manual control including a pair of manually operable devices each linked to said platform and being operable to move said platform with at least two degrees of freedom; and a coaster for traveling back and forth freely on said traveling surface, said end ramps being inclined to cause reversion of said coaster.

2. A plaything according to claim 1 wherein said coaster comprises:

a carriage with a plurality of wheels.

3. A plaything according to claim 2 wherein said coaster is arranged to depict a skateboard.

4. A plaything according to claim 2 wherein said coaster is arranged to depict one of either a skateboard, a snowboard, a bicycle, an automobile, or skier.

5. A plaything according to claim 1 wherein the end ramps of said platform include an upper portion of the traveling surface that is higher than any other portion of the traveling surface.

6. A plaything according to claim 1 wherein said traveling surface is concave along its transverse centerline.

7. A plaything according to claim 1 wherein said traveling surface has an opposing pair of longitudinal fences.

8. A plaything according to claim 1 wherein most of said traveling surface is concave in a transverse direction.

9. A plaything according to claim 1 wherein said platform is mounted to reciprocate rotationally with at least one degree of freedom.

10. A plaything for executing a reciprocating activity comprising:

a base:

a curved platform reciprocatably mounted on said base, said platform having a traveling surface with a longitudinally spaced, opposing pair of end ramps;

a coaster for traveling back and forth freely on said traveling surface, said end ramps being inclined to cause reversion of said coaster; and at least one manual control linked to said platform and manually operable to move said platform, said manual control being mounted on said base, said manual control comprising at least one joystick mounted on said base and able to move with two degrees of freedom.

11. A plaything for executing a reciprocating activity comprising:

a base:

a curved platform reciprocatably mounted on said base, said platform having a traveling surface with a longitudinally spaced, opposing pair of end ramps;

a coaster for traveling back and forth freely on said traveling surface, said end ramp being inclined to cause reversion of said coaster; and at least one manual control linked to said platform and manually operable to move said platform, said manual control being mounted on said base and comprising a pair of joysticks mounted on said base.

12. A plaything for executing a reciprocating activity comprising:

a base having a control panel;

a curved platform reciprocatably mounted on said base, said platform having a traveling surface with a longitudinally spaced, opposing pair of end ramps;

a coaster for traveling back and forth freely on said traveling surface, said end ramps being inclined to cause reversion of said coaster; and at least one manual control linked to said platform and manually operable to move said platform, said manual control being mounted on said base, said manual control comprising:

at least one joystick having a ball, and a distal external shaft projecting from said ball, the ball of said joystick being rotatably mounted at said control panel.

13. A plaything according to claim 12 wherein said joystick has an internal proximal shaft projecting from said ball and linked to said platform.

14. A plaything for executing a reciprocating activity comprising:

a base:

a curved platform reciprocatably mounted on said base, said platform having a traveling surface with a longitudinally spaced, opposing pair of end ramps, said platform having a plurality of subjacent rollers for rolling atop said base;

a coaster for traveling back and forth freely on said traveling surface, said end ramps being inclined to cause reversion of said coaster; and at least one manual control linked to said platform and manually operable to move said platform, said manual control being mounted on said base.

15. A plaything according to claim 14 wherein said base has a topside with a central hole, said at least one manual control being (a) mounted on said base, (b) linked to said platform through the hole in the topside of said base, and (c) manually operable to move said platform.

16. A plaything according to claim 15 comprising:

a plate mounted in said base and subjacently attached to said platform through the hole in the topside of said base, said plate extending toward and connected said manual control.

17. A plaything according to claim 16 wherein said base has a control panel, said manual control comprising:

at least one joystick having (a) a ball rotatably mounted at said control panel, (b) a distal external shaft projecting from said ball, and (c) an internal proximal shaft projecting from said ball and linking to said plate.

18. A plaything according to claim 16 wherein said base has a control panel, said manual control comprising:

a pair of joysticks each having (a) a ball rotatably mounted at said control panel, (b) a distal external shaft projecting from said ball, and (c) an internal proximal shaft projecting from said ball and linking to said plate.

* * * * *